US005912055A

United States Patent [19]

Gore et al.

[11] Patent Number: 5,912,055

[45] Date of Patent: Jun. 15, 1999

[54] COATING METAL STRIP

[76] Inventors: Leslie George Gore, 9/164E Burwood Road, Concord NSW 2137; Robert John Henson, 5 Burrows Avenue, Kanahooka NSW 2530; Palanisami Karunakaran, 28 Pendelton Close, Tarrawanna NSW 2518, all of Australia

[21] Appl. No.: 09/086,381

[22] Filed: May 29, 1998

[30] Foreign Application Priority Data

Dec. 22, 1997 [AU] Australia ..... PP1079

[51] Int. Cl.[6] ..... B05D 1/18; B05D 1/36

[52] U.S. Cl. ..... 427/431; 427/405; 427/406; 427/433; 427/443.2; 427/436

[58] Field of Search ..... 427/405, 406, 427/431, 433, 436, 443.2; 118/412, 429

[56] References Cited

U.S. PATENT DOCUMENTS

| | | | |
|---|---|---|---|
| 1,258,071 | 3/1918 | Winter . | |
| 3,130,068 | 4/1964 | Whitley . | |
| 3,592,160 | 7/1971 | Schwieterman et al. . | |
| 3,643,627 | 2/1972 | Killin et al. . | |
| 3,875,896 | 4/1975 | Trattner et al. | 118/74 |
| 4,190,017 | 2/1980 | Bizik et al. . | |
| 4,645,694 | 2/1987 | Gerard | 427/431 |
| 4,958,589 | 9/1990 | Homma et al. . | |
| 5,453,127 | 9/1995 | Flinchum et al. . | |

FOREIGN PATENT DOCUMENTS

| | | |
|---|---|---|
| 1538560 | 9/1968 | France . |
| 741952 | 10/1978 | U.S.S.R. . |
| 556128 | 9/1943 | United Kingdom . |
| 1565874 | 3/1977 | United Kingdom . |
| 2124659 | 6/1982 | United Kingdom . |

*Primary Examiner*—Shrive Beck
*Assistant Examiner*—Michael Barr
*Attorney, Agent, or Firm*—Kerkam, Stowell, Kondracki & Clarke, P.C.; John C. Kerins

[57] ABSTRACT

An apparatus for continuous hot-dip coating of metal strip is provided. The apparatus includes a first coating pot to hold a molten bath of a first coating metal and a first metal heating means to heat the bath of molten metal in the first pot. The apparatus also includes a second coating pot to hold a molten bath of a second coating metal, which second pot is shallow in relation to the first pot and is positionable within an upper part of the first but removable therefrom, and a second metal heating means operable to heat the molten bath of metal in the second pot. The apparatus also includes a strip feed means to feed strip into and from the upper part of the first pot when the second pot is removed therefrom whereby to dip the strip in the molten bath of the first coating metal and alternatively operable to feed the strip into and from the molten bath in the second coating pot when the second coating pot is positioned in the upper part of the first coating pot whereby to dip the strip within the bath of the second coating metal.

8 Claims, 3 Drawing Sheets

COATING METAL STRIP

This invention relates to the application of protective coatings to metal strip by hot-dip coating. The invention has particular but not exclusive application to the continuous hot-dip coating of steel strip with protective metallic coatings of zinc or aluminium-zinc alloy.

BACKGROUND OF THE INVENTION

In the hot-dip galvanising process, steel strip is thoroughly cleaned by acid pickling, alkaline cleaning or other preparatory treatment and is then generally passed through an annealing furnace and kept under the protection of a reducing furnace atmosphere until it passes into a bath of coating metal held in a coating pot. The coating metal is usually maintained molten in the coating pot by the use of heating inductors. The strip may pass through an elongate furnace exit chute or snout which dips into the bath. Within the bath the strip passes around one or more sink rolls and is taken upwardly out of the bath. After leaving the coating bath the strip may pass through a gas knife or gas wiping station in which its coated surfaces are subjected to jets of wiping gas to control the thickness of the coating.

In a normal galvanising process the coating metal may be zinc or zinc with about 0.2% of aluminium by weight. This produces a standard galvanised steel which has moderate corrosion resistance and can be produced at moderate cost. Superior coatings can be obtained with zinc and aluminium alloys having a much higher aluminium content, for example in the range 25–70%.

There is presently a need to provide a hot-dip coating plant which can be operated in alternative modes either to produce highly corrosion resistant strip coated with a zinc-aluminium alloy of high aluminium content or alternatively to produce standard galvanised strip with a predominantly zinc coating. In particular, there are many existing plants around the world producing the high corrosion resistant strip coated with zinc-aluminium alloy in locations where there is still a demand for the standard galvanized strip and there is accordingly a need to be able to convert existing plant for production of both kinds of strip.

It is not commercially or technically attractive to use the same coating pot to hold both kinds of coating metal. This would require the pot to be totally pumped out or emptied on changing from one form of coating to the other, which will inevitably result in damage to the coating metal heating inductors and refractories in the pot. It is also extremely time consuming and generates metals which need to be reclaimed. Moreover, it is very difficult to produce a bath of almost pure zinc in a pot which has previously contained a metal with a high proportion of aluminium.

It is known to provide two fixed coating pots side by side and make parts of the strip feed lines and furnace moveable to line up alternatively with one pot or the other. However, this is extremely expensive and involves difficult engineering of the moveable parts. It is also known to move and replace the coating pot with a similar substitute pot but this is also extremely expensive and time consuming. The present invention provides an alternative solution by which a main coating pot can be used for coating strip with a first coating metal and a second, shallower coating pot can be positioned within the upper part of the main coating pot to enable coating with a second coating metal.

SUMMARY OF THE INVENTION

According to the invention there is provided apparatus for continuous hot-dip coating of metal strip, having:

- a first coating pot to hold a molten bath of a first coating metal;
- first metal heating means to heat the bath of molten metal in the first pot;
- a second coating pot to hold a molten bath of a second coating metal which second pot is shallow in relation to the first pot and is positionable within an upper part of the first but removable therefrom;
- second metal heating means operable to heat the molten bath of metal in the second pot; and
- strip feed means to feed strip into and from the upper part of the first pot when the second pot is removed therefrom whereby to dip the strip in the molten bath of the first coating metal and alternatively operable to feed the strip into and from the molten bath in the second coating pot when the second coating pot is positioned in the upper part of the first coating pot whereby to dip the strip within the bath of the second coating metal.

Preferably the apparatus further includes a furnace to heat the strip prior to being hot-dip coated.

Preferably further the furnace has an elongate exit chute or snout to enclose the strip as it is fed by the strip feed means into the molten bath of the first coating metal or into the molten bath of the second coating metal without exposure to the air.

Preferably further the apparatus includes gas wiping means to wipe the dipped strip as it leaves the molten bath of the first coating metal or the molten bath of the second coating metal to control the thickness of the coating.

The apparatus may further include sink roll means to guide the strip within the coating baths.

The sink roll means may include one or more sink rolls or pair of sink rolls positionable in the first coating pot when the second pot is removed to guide the strip within the molten bath in the first coating pot and one or more further sink rolls positionable in the second coating pot to guide the strip in the molten bath in the second coating pot when the second coating pot is positioned in the upper part of the first coating pot.

The one or more further sink rolls may be smaller than the one or more sink rolls positionable in the first coating pot.

Preferably, there is a pair of further sink rolls positionable in the second coating pot.

Preferably further, that pair of sink rolls is positionable to accommodate entry and exit of the strip to and from the molten bath in the second coating pot at substantially the same strip orientations as for the first Sink roll or rolls when the strip is to be dipped into the molten bath in the first coating pot.

The first metal heating means may include electrical induction heaters disposed about the first coating pot.

The second metal heating means may include electrical resistance heaters extending around the second coating pot.

The second coating pot may have steel walls and the electrical resistance heaters may be mounted to the outer surfaces of those walls.

The invention further provides a method of coating strip in a hot-dip coating plant so as to change the kind of coating applied to the strip, including the steps of:

- passing strip through a molten bath of a first coating metal held in a first coating pot and maintained in a molten state by operation of induction heater means having metal flow channels in communication with the bath whereby to produce coated strip coated with the first coating metal;

stopping the strip coating operation;

reducing the level of the molten bath of said first coating metal in the first coating pot to empty an upper part of the first coating pot without disrupting the communication of the induction heater channels with the molten bath;

positioning within the emptied upper part of the first coating pot a second coating pot which is shallow relative to the first coating pot and is supported above the reduced level of the molten bath of the first coating metal;

forming a molten bath of a second coating metal in the second coating pot; and passing strip through the molten bath of the second coating metal in the second coating pot to produce coated strip which is coated with the second coating metal.

Preferably, the induction heating channels connect with the interior of the first coating pot at or below the reduced level of the molten bath therein so as to remain filled with the first molten metal throughout coating of the strip with both the first and second coating metals.

Preferably the molten bath of the second coating metal is formed in the second coating pot by pre-melting the second coating metal and pouring that melted metal into the second coating pot.

Preferably the molten bath of the second coating metal is maintained in a molten state during dip coating of the strip therein by heating the molten bath by the operation of electrical heaters external to the second coating pot. Preferably such heating is effected by the operation of electrical resistance heaters external to the second coating pot.

Preferably further the molten metal in the reduced level bath of the first coating metal is maintained in a molten state during hot-dip coating of the strip in the second coating pot by operation of metal heating means associated with the first coating pot, The strip may be passed around a first one or more sink rolls in the first coating pot during coating with the first coating metal and may be passed around a further one or more sink rolls in the second coating pot during coating with the second coating metal.

In this case, the first one or more sink rolls may be removed from the first coating pot before the second coating pot is positioned in the upper part thereof.

More specifically, the first one or more sink rolls may be removed from the first coating pot before the step of reducing the level of the molten bath of the first coating metal.

BRIEF DESCRIPTION OF THE DRAWINGS

In order that the invention may be more fully explained one particularly embodiment will be described in some detail with reference to the accompanying drawings in which.

DESCRIPTION OF THE INVENTION

Figure 1:
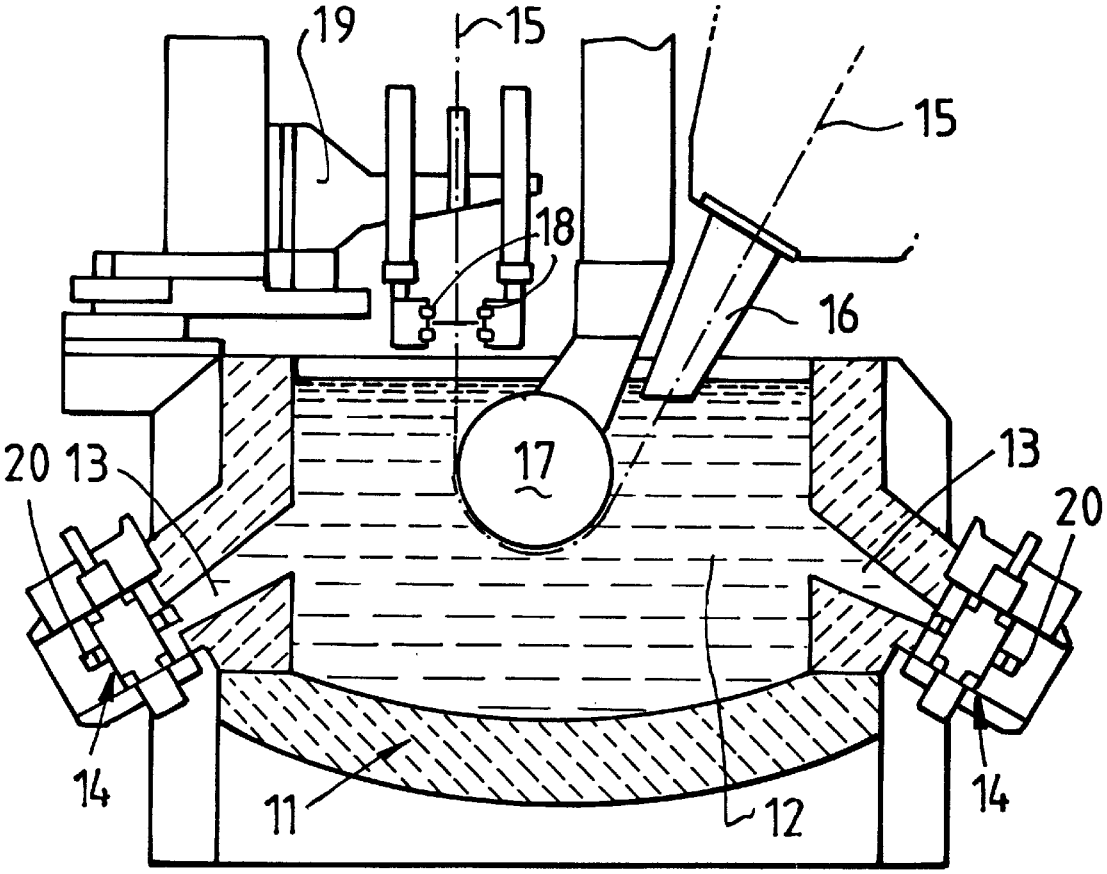
FIG. 1 is a vertical cross-section through part of a hot-dip coating plant incorporating a main coating pot used for hot dipping steel strip with a zinc-aluminium alloy.

The illustrated hot-dip coating plant comprises a main coating pot denoted generally as 11 to contain a molten coating bath 12 of a zinc-aluminium alloy which may have an aluminium content in the range 25 to 70%. Coating pot 11 is formed as a large refractory lined, induction heated furnace having outer peripheral metal flow passages 13 and induction heaters 14 to maintain the bath 12 of molten metal in a liquid state. The induction heaters have generally U-shaped metal flow channels 20 encircled by ferromagnetic rings fitted with energising coils so that in use molten metal is caused to flow from passages 13 around the looped inductor channels 20 so as to be inductively heated and jetted back into the bath through passages 13.

An induction-heated pre-melt furnace (not shown) is located beside the coating pot 11 and the bath 12 is initially established by pumping pre-melted coating metal from the pre-melting furnace to the coating pot whereafter it is maintained in the molten condition by the operation of induction heaters 14.

The steel strip 15 may be annealed before hot dipping into the coating pot so as to soften it for good formability. The strip is supplied from an annealing furnace through a furnace exit chute or snout 16 which dips into the bath of molten metal in the coating pot so that the strip is held in a reducing atmosphere of hot furnace gases without being exposed to air up until the time that it enters the coating bath 12.

FIG. 1 illustrates the apparatus in a condition for hot dipping the strip into the bath 12 of zinc-aluminium alloy in coating pot 11. For this mode of operation the coating pot 11 is fitted with a large diameter sink roll 17 and the bath 12 is maintained at such a level as to substantially fill the coating pot so that the sink roll 17 is submerged within the bath, The strip 15 passes within the bath around sink roll 17 and is drawn upwardly out of the bath through cooling sprays (not shown) and around elevated turn around rolls (also not shown) which are set at a height sufficient to ensure that full solidification of the metal coating before it engages those rolls.

As it leaves the bath the coated strip passes between a pair of gas knives 18 which direct jets of wiping gas onto the coated surfaces of the strip so as to control the coating thickness. The gas knives 18 are mounted on a support frame 19 and can be readily moved to a retracted or remote position when the plant is to be converted for zinc coating in the manner to be described below. Gas knives 18 may be of conventional construction. Alternatively, they may be in the form of floater pads provided with gas knives in the manner described in Australian Patent No. 630281.

The hot dip coating plant as thus far described and as illustrated in FIG. 1 is conventional. However, in accordance with the present invention the plant may be converted to enable hot dip coating of the strip with a metal coating of a different composition. The conversion involves the positioning of a relatively shallow secondary coating pot 21 within the upper part of the main coating pot 11 and the replacement of the relatively large diameter sink roll 17 with a pair of smaller diameter sink rolls 22 as illustrated in FIGS. 2 to 6.

Secondary coating pot 21 is formed with an upper perimeter frame 23 to rest on the upper rim of the main coating pot 11 and a main tub portion 24 which extends into the upper part of the main coating pot 11. Tub portion 24 is sufficiently shallow that it can be located above a bath of molten metal retained in the main coating pot 11 to a level sufficient to keep the gallery 13 and induction heaters 14 submerged with molten metal. The smaller diameter sink rolls 22 are rotatable between end support arms 28 depending from the main frame of the apparatus and are completely submerged within a bath 25 of zinc held within the secondary coating pot. The hot zinc bath may initially be established by pumping from a separate premelt furnace (not shown) installed beside the main coating pot 11. The zinc pre-melting furnace will usually be separate from the pre-melt furnace for the zinc-aluminium alloy.

The small diameter sink rolls 22 are spaced across the floor of the bath portion 24 of the small coating pot so that the strip 15 can enter and leave the bath 25 in the secondary coating pot 21 with the same strip orientations as those which previously applied when hot dipping into the bath in the main coating pot. Thus the strip can simply be fed with the same strip means through furnace snout 16 into the bath and may be taken away vertically by the Strip feed means in the form of a turn around roll (not shown) and between the gas knives 18.

Figure 5:
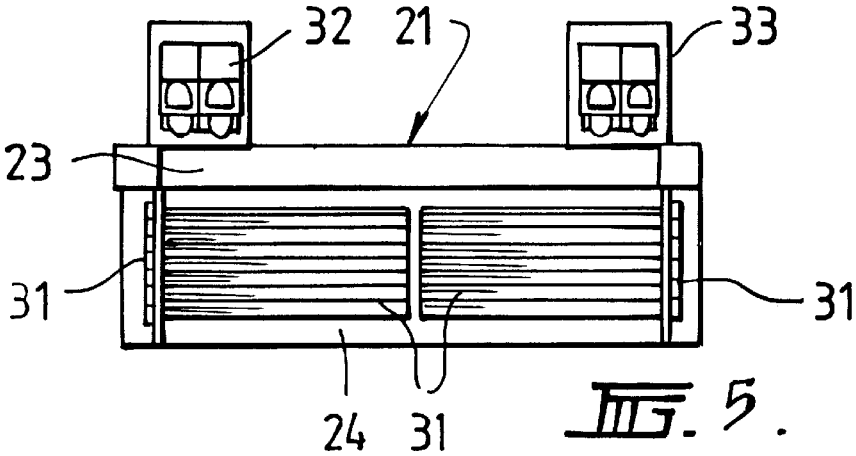
FIG. 5 is a side-elevation of the secondary coating pot.
Figure 6:
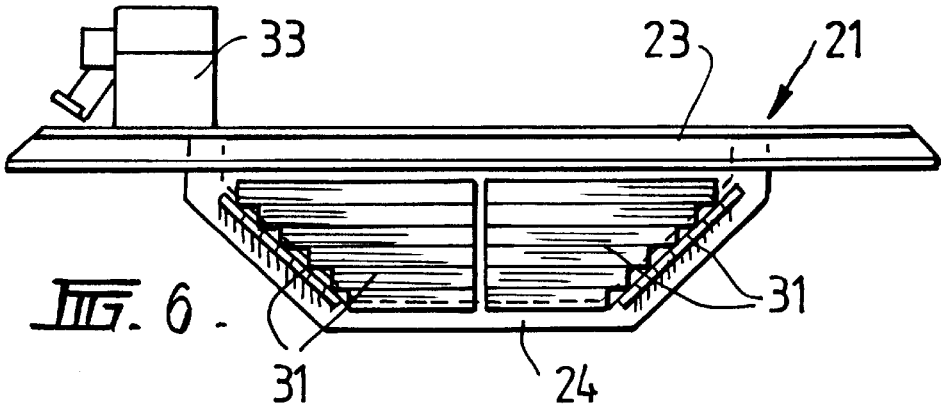
FIG. 6 is an end-elevation of the secondary coating pot.

In order to maintain the zinc bath 25 in molten condition, the secondary coating pot 21 is provided with electrical resistance heaters 31 attached to the outer surfaces of the steel walls of the bath portion 24 of that pot. As illustrated in FIGS. 5 and 6 heaters 31 may be in the form of electrical resistance heaters extending in parallel formation around the perimeter of the bath portion 24 and connected to supply and return sockets 32, 33. In a typical installation, the secondary coating pot may have a capacity of about 3.5 $m^3$ which equates to about 21 tonnes of zinc requiring a heating capacity of up to 300 kwatts to balance heat losses and maintain the zinc bath in a molten state.

Figure 2:
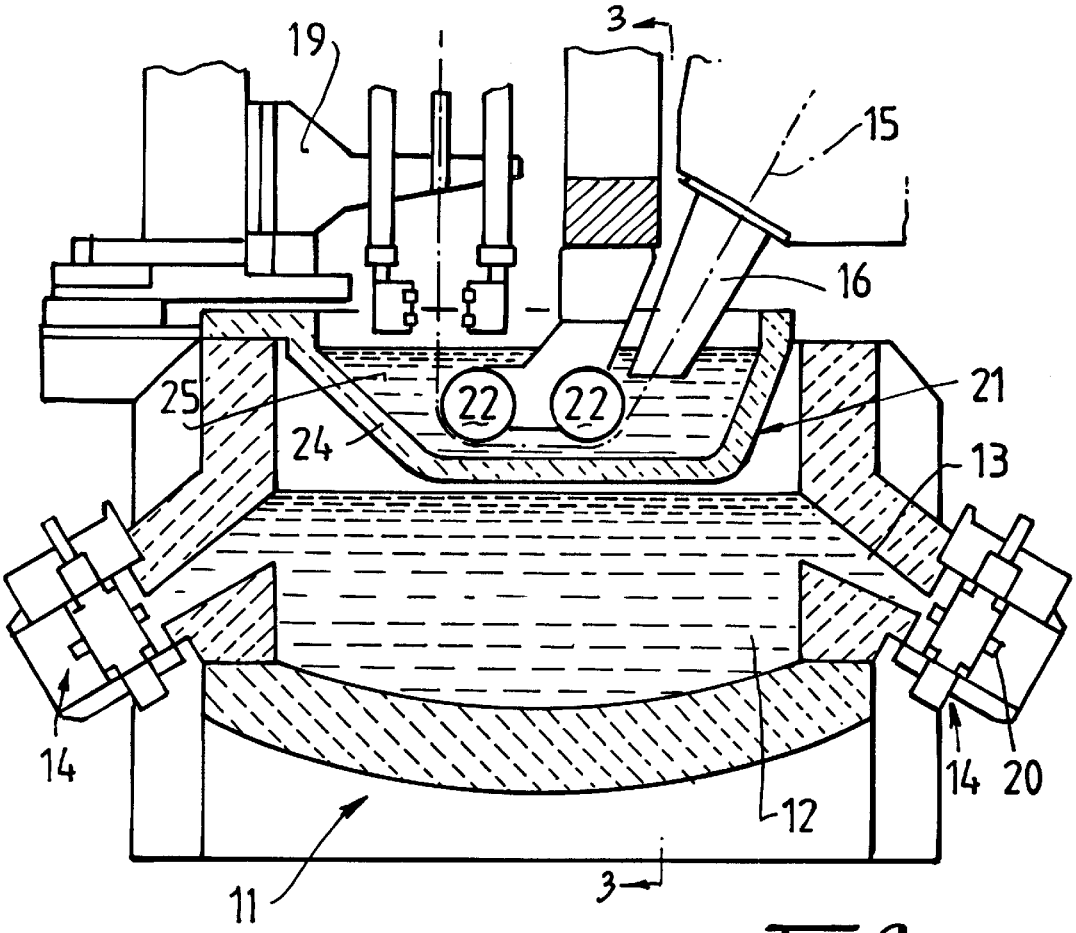
FIG. 2 is a cross-section similar to FIG. 1 but showing the plant modified by installation of a secondary shallow coating pot for dip coating the steel strip with an essentially zinc coating.
Figure 3:
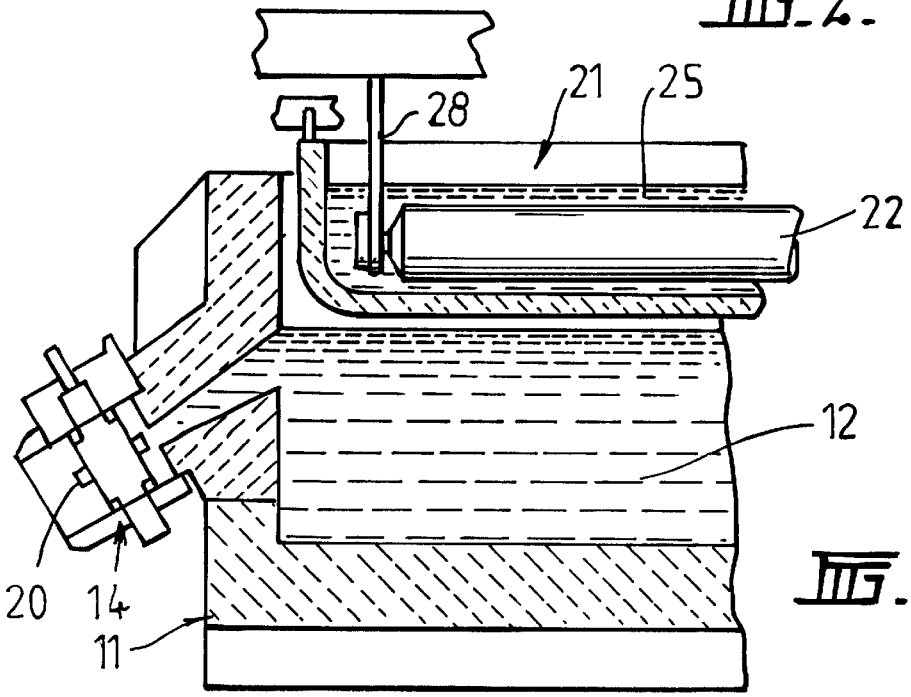
FIG. 3 is a cross-section on the line 3—3 in FIG. 2.
Figure 4:
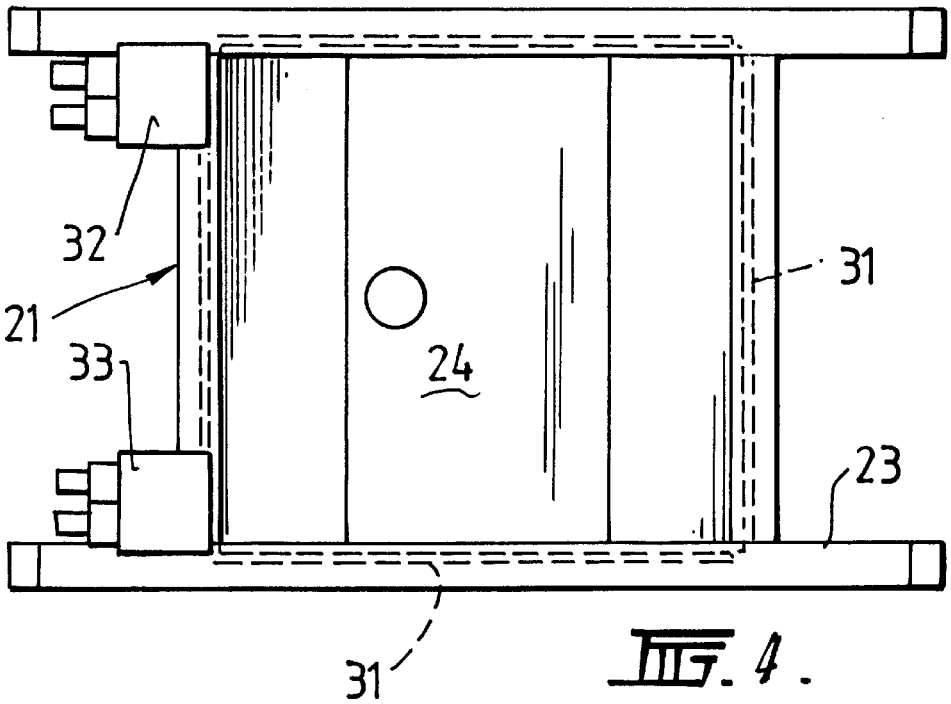
FIG. 4 is a detailed plan of the shallow secondary coating pot.

In order to convert the apparatus from the condition shown in FIG. 1 in which it is used for coating the strip with a zinc-aluminium alloy to the condition shown in FIG. 2 in which it is operable to galvanise the strip with zinc it is necessary to carry out the following steps:

1. Dip coating of strip 15 with the zinc-aluminium alloy is stopped. The strip is severed and both ends of the severed strip are held out of the coating pot.
2. The equipment over the upper mouth of main coating pot 11 is moved away, including the sink roll 17 and gas knives 18.
3. Zinc-aluminium alloy is pumped from or drained from coating pot 11 to reduce the level of the bath within the main coating pot to the level shown in FIG. 2 and the furnace snout 16 is removed.
4. The secondary coating pot 21 is brought into position and supported within the upper part of the main coating pot 11 with its lower end close to but above the residual bath of zinc-aluminium alloy in the main coating pot.
5. The smaller diameter sink rolls 22 are installed within the secondary coating pot.
6. The furnace snout 16 and gas wiping knives 18 are brought back into their operative positions.
7. Molten zinc is pumped from the zinc pre-melt furnace into secondary coating pot 21.
8. The strip 15 is threaded through the bath and to the feed rolls and hot dipping with zinc coating proceeds.
9. Induction heaters 14 are operated throughout at a reduced intensity sufficient to maintain the zinc-aluminium metal in coating pot 11 in a liquid state.

The present invention enables reasonably simple and rapid conversion of a hot-dip coating plant to coating with different metal coatings or alloys. Because separate coating pots are used for the different coating metals there is no cross contamination of the two. Moreover, the invention enables conversion of existing plants for dual coating operation at moderate expense.

We claim:

1. A method of coating strip in a hot-dip coating plant so as to change the kind of coating applied to the strip, including the steps of:

passing strip through a molten bath of a first coating metal held in a first coating pot and maintained in a molten state by operation of induction heater means having metal flow channels in communication with the bath whereby to produce coated strip coated with the first coating metal;

stopping the strip coating operation;

reducing the level of the molten bath of said first coating metal in the first coating pot to empty an upper part of the first coating pot without disrupting the communication of the induction heater channels with the molten bath;

positioning within the emptied upper part of the first coating pot a second coating pot which is shallow relative to the first coating pot and is supported above and is without contact with the reduced level of the molten bath of the first coating metal;

forming a molten bath of a second coating metal in the second coating pot; and passing strip through the molten bath of the second coating metal in the second coating pot to produce coated strip which is coated with the second coating metal.

2. The method defined in claim 1 wherein the induction heating channels connect with the interior of the first coating pot at or below the reduced level of the molten bath therein so as to remain filled with the first molten metal throughout coating of the strip with both the first and second coating metals.

3. The method defined in claim 1 includes forming the molten bath of the second coating metal in the second coating pot by pre-melting the second coating metal and pouring that melted metal into the second coating pot.

4. The method defined in claim 1 includes maintaining the molten bath of the second coating metal in a molten state during dip coating of the strip therein by heating the molten bath by the operation of electrical heaters external to the second coating pot.

5. The method defined in claim 1 includes maintaining the molten metal in the reduced level bath of the first coating metal in a molten state during hot-dip coating of the strip in the second coating pot by operation of said induction heater means associated with the first coating pot.

6. The method defined in claim 1 includes passing the strip around a first one or more sink rolls in the first coating pot during coating with the first coating metal and passing the strip around a further one or more sink rolls in the second coating pot during coating with the second coating metal.

7. The method defined in claim 6 includes removing the first one or more sink rolls from the first coating pot before the second coating pot is positioned in the upper part thereof.

8. The method defined in claim 7 includes removing the first one or more sink rolls from the first coating pot before the step of reducing the level of the molten bath of the first coating metal.

* * * * *